US007527700B2

(12) United States Patent
Kariya et al.

(10) Patent No.: US 7,527,700 B2
(45) Date of Patent: May 5, 2009

(54) HIGH STRENGTH HOT ROLLED STEEL SHEET AND METHOD FOR MANUFACTURING THE SAME

(75) Inventors: Nobusuke Kariya, Kawasaki (JP); Shusaku Takagi, Fukuyama (JP); Tetsuo Shimizu, Chiba (JP); Tetsuya Mega, Sendai (JP); Kei Sakata, Handa (JP); Hiroshi Takahashi, Chiba (JP)

(73) Assignee: JFE Steel Corporation, Tokyo (JP)

( * ) Notice: Subject to any disclaimer, the term of this patent is extended or adjusted under 35 U.S.C. 154(b) by 254 days.

(21) Appl. No.: 10/543,489

(22) PCT Filed: Apr. 21, 2004

(86) PCT No.: PCT/JP2004/005743

§ 371 (c)(1),
(2), (4) Date: Jul. 26, 2005

(87) PCT Pub. No.: WO2004/094681

PCT Pub. Date: Nov. 4, 2004

(65) Prior Publication Data

US 2006/0096678 A1 May 11, 2006

(30) Foreign Application Priority Data

Apr. 21, 2003 (JP) ..... 2003-115852
Apr. 20, 2004 (JP) ..... 2004-124154

(51) Int. Cl.
*C22C 38/00* (2006.01)

(52) U.S. Cl. ..... 148/320; 148/602

(58) Field of Classification Search ..... 420/124; 148/320, 602

See application file for complete search history.

(56) References Cited

U.S. PATENT DOCUMENTS

2003/0063996 A1 4/2003 Funakawa et al.

FOREIGN PATENT DOCUMENTS

| | | |
|---|---|---|
| EP | 1 195 447 A1 | 4/2002 |
| JP | A-2000-239791 | 9/2000 |
| JP | A-2000-336455 | 12/2000 |
| JP | A-2001-089811 | 4/2001 |

*Primary Examiner*—George Wyszomierski
*Assistant Examiner*—Weiping Zhu
(74) *Attorney, Agent, or Firm*—Oliff & Berridge, PLC

(57) ABSTRACT

The present invention relates to a high strength hot rolled steel sheet consisting of 0.04 to 0.15% C, 1.5% or less Si, 0.5 to 1.6% Mn, 0.04% or less P, 0.005% or less S, 0.04% or less Al, 0.03 to 0.15% Ti, 0.03 to 0.5% Mo, by mass, and balance of Fe and inevitable impurities, and having a microstructure consisting of ferrite containing precipitates, second phase of bainite and/or martensite, and other phase, wherein the percentage of the ferrite containing precipitates is 40 to 95%, and the percentage of the other phase is 5% or less. For example, the high strength hot rolled steel sheet having a thickness of 1.4 mm shows a tensile strength of 780 MPa or higher, an elongation of 22% or higher elongation, and a hole expansion ratio of 60% or higher, thus the steel sheet is suitable for reinforcing members automobile cabin and crash worthiness members of automobile.

4 Claims, No Drawings

HIGH STRENGTH HOT ROLLED STEEL SHEET AND METHOD FOR MANUFACTURING THE SAME

TECHNICAL FIELD

The present invention relates to a high strength hot rolled steel sheet having a tensile strength of 780 MPa or more, which is to be used for reinforcing members of automobile cabin or the like, particularly to a high strength hot rolled steel sheet having excellent elongation and stretch-flangeability, and to a method for manufacturing the same.

BACKGROUND ART

Formerly, the hot rolled steel sheet was not applied to the reinforcing members of automobile cabin from the viewpoint of its poor formability. In recent years, however, the increasing need for steel sheets having low cost and high formability has encouraged the study on the application of the inexpensive hot rolled steel sheet to these members. In particular, the hot rolled steel sheet which is inferior in the surface property to the cold rolled steel sheet is suitable for these inner members. Although there are increased uses of high strength hot rolled steel sheets having a tensile strength of 440 to 590 MPa to crashworthiness members such as a front side member of automobile, higher strengthening of these high strength hot rolled steel sheets is desired.

The hot rolled steel sheet to be applied to these members is required to have a high tensile strength of 780 MPa or more and excellent elongation and stretch-flangeability. Particularly, the hole expansion ratio, which is a criterion of the stretch-flangeability, should be 60% or more.

For improving the elongation, JP-A-7-62485, (the term "JP-A" referred to herein signifies "Japanese Patent Laid-Open Publication"), proposes a dual phase steel sheet in which hard second phase of residual austenite is dispersed in a matrix of ferrite. The steel sheet, however, does not have excellent stretch-flangeability because of the large difference in hardness between the matrix of ferrite and the second phase of residual austenite.

JP-A-9-263885 provides a dual phase steel sheet of which the elongation and the stretch-flangeability are improved by precipitation hardening the matrix of ferrite to decrease the difference in hardness between the matrix of ferrite and the second phase of martensite. The steel sheet, however, gives a tensile strength below 780 MPa, and therefore is not suitable for the reinforcing members of automobile cabin or the crashworthiness members of automobile.

As a dual phase steel sheet having a tensile strength of 780 MPa or more, JP-A-5-179396 proposes a steel sheet having the stretch-flangeability improved by precipitation hardening the matrix of ferrite and decreasing the volume fraction of the second phase of martensite or residual austenite. Although the carbon equivalent of the steel sheet is decreased to improve the spot-weldability and the fatigue characteristic, the hole expansion ratio is at most 46%, which does not give sufficient stretch-flangeability for the reinforcing members of automobile cabin and the crashworthiness members in complex shape of automobile.

DISCLOSURE OF INVENTION

An object of the present invention is to provide a high strength hot rolled steel sheet having a tensile strength of 780 MPa or more, excellent elongation, and excellent stretch-flangeability giving a hole expansion ratio of 60% or more.

The object is attained by a high strength hot rolled steel sheet consisting of 0.04 to 0.15% C, 1.5% or less Si, 0.5 to 1.6% Mn, 0.04% or less P, 0.005% or less S, 0.04% or less Al, 0.03 to 0.15% Ti, 0.03 to 0.5% Mo, by mass, and balance of Fe and inevitable impurities, and having a microstructure consisting of ferrite containing precipitates, second phase of bainite and/or martensite, and other phase, wherein the percentage of the ferrite containing precipitates is 40 to 95%, and the percentage of the other phase is 5% or less.

The high strength hot rolled steel sheet is manufactured by a method comprising the steps of: reheating a steel slab having the above-described composition in a temperature range from 1150 to 1300° C.; hot rolling the reheated steel slab at a finishing temperature of the Ar3 transformation temperature or above into a hot rolled steel sheet; primarily cooling the hot rolled steel sheet in a temperature range from 700 to 850° C. at an average cooling rate of 20° C./s or more; holding the primarily cooled steel sheet at a temperature of 680° C. or above for more than 1 sec; and secondarily cooling the steel sheet at a temperature of 550° C. or below at an average cooling rate of 30° C./s or more, followed by coiling the steel sheet.

EMBODIMENTS OF THE INVENTION

The inventors of the present invention studied the high strength hot rolled steel sheets which can be applied to the reinforcing members of automobile cabin and the crashworthiness members of automobile, and derived the following findings.

a) When the microstructure is controlled to have ferrite containing precipitates, second phase of bainite and/or martensite, and other phase such as ferrite without precipitates, pearlite, and residual austenite, and that the percentage of the ferrite is controlled to 40 to 95% and the percentage of other phase to 5% or less, the tensile strength of 780 MPa or more, the excellent elongation, and the excellent stretch-flangeability giving a hole expansion ratio of 60% or more are obtained.

b) When the precipitates in the ferrite contain Ti and Mo, and that the mean diameter of the precipitates is 20 nm or less and the mean distance between the precipitates is 60 nm or less, the ferrite becomes stronger, and the difference in hardness between the ferrite and the second phase becomes smaller, leading to further excellent stretch-flangeability.

The present invention was perfected based on the above-findings. The detail of the present invention is described below.

1) Chemical Composition

C: Carbon is necessary to be added by 0.04% or more for obtaining a tensile strength of 780 MPa or more. If, however, the C content exceeds 0.15%, the second phase increases to degrade the stretch-flangeability. Accordingly, the C content is specified to 0.04 to 0.15%, preferably 0.04 to 0.1%, and more preferably 0.05 to 0.08%.

Si: Silicon is effective to improve the elongation and the stretch-flangeability. If, however, the Si content exceeds 1.5%, the surface properties significantly degrade, and the corrosion resistance degrades. Furthermore, the deformation resistance during hot rolling increases to make it difficult to manufacture a steel sheet having a thickness less than 1.8 mm. Therefore, the Si content is specified to 1.5% or less, preferably 1.2% or less, and more preferably 0.3 to 0.7%.

Mn: Manganese is necessary to be added by 0.5% or more to attain a tensile strength of 780 MPa or more. If, however, the Mn content exceeds 1.6%, the weldability significantly degrades. Consequently, the Mn content is specified to 0.5 to 1.6%, preferably 0.8 to 1.4%.

P: If the P content exceeds 0.04%, P segregates in prior-austenite (γ) grain boundaries to significantly degrade the low temperature toughness and to increase the anisotropy of steel sheet, which significantly degrades the workability. Accordingly, the P content is specified to 0.04% or less, preferably 0.025% or less, and more preferably 0.015% or less.

S: If the S content exceeds 0.005%, S segregates in prior-γ grain boundaries and precipitates as MnS to significantly degrade the low temperature toughness, which is not suitable for the steel sheet of automobile for cold area service. Consequently, the S content is specified to 0.005% or less, preferably 0.003% or less.

Al: Aluminum is added as a deoxidizer of steel to effectively increase the cleanliness of the steel. To attain the effect, Al is preferably added by 0.001% or more. If, however, the Al content exceeds 0.04%, large amount of inclusions is produced to cause surface defects. Therefore, the Al content is specified to 0.04% or less.

Ti: Titanium precipitates in ferrite to strengthen the ferrite. Thus Ti is an important element to attain a tensile strength of 780 MPa or more. Since Ti strengthens the ferrite, the difference in hardness between the ferrite and the hard second phase becomes small to improve the stretch-flangeability. To do this, Ti is required to be added by 0.03% or more. If, however, the Ti content exceeds 0.15%, the effect saturates and the cost increases. Therefore, the Ti content is specified to 0.03 to 0.15%, preferably 0.05 to 0.12%.

Mo: Molybdenum precipitates as carbide, and is a significantly effective element to strengthen the ferrite. If Mo does not exist, it is very difficult to obtain a tensile strength of 780 MPa or more. Since Mo strengthens the ferrite, the difference in hardness between the ferrite and the hard second phase becomes small, thus improving the stretch-flangeability. To attain the effect, the Mo content is requested to be 0.03% or more. If, however, the Mo content exceeds 0.5%, the effect saturates and the cost increases. Consequently, the Mo content is specified to 0.03 to 0.5%.

2) Microstructure

As described above, to obtain the elongation and the stretch-flangeability suitable for the reinforcing members of automobile cabin and the crashworthiness members of automobile, it is necessary that the microstructure of steel consists of ferrite containing precipitates, second phase of bainite and/or martensite, and other phase such as ferrite without precipitates, pearlite, and residual austenite, and that the percentage of the ferrite containing precipitates is 40 to 95% and the percentage of the other phase is 5% or less.

If the percentage of the ferrite containing precipitates is less than 40%, excessive amount of the hard second phase is formed, and if the percentage thereof exceeds 95%, the amount of the hard second phase becomes excessively small, both of which degrade the elongation.

The term "ferrite containing precipitates" referred to herein designates the ferrite containing fine precipitates having precipitation hardening ability, which can be observed by transmission electron microscope (TEM) or the like. The percentage of the ferrite containing precipitates was determined by the following procedure.

Three specimens for TEM observation were sampled from the steel sheet at a position of ¼ of sheet thickness, and observed by TEM (one million of magnification) to determine the areal percentage of the ferrite containing observed precipitates to the total ferrite area. Next, the cross section of the steel sheet was polished, etched by 3% Nital, and observed by optical microscope (400 of magnification) at a position of ¼ of sheet thickness to determine the areal percentage of ferrite by image processing. Then, the product of the areal percentage of the ferrite containing observed precipitates determined by TEM observation and the areal percentage of the ferrite determined by optical microscope observation was calculated to obtain the areal percentage of the ferrite containing precipitates.

The microstructure other than the ferrite containing precipitates consists of second phase of bainite and/or martensite and other phase such as ferrite without precipitates, pearlite, and residual austenite. The percentage of the other phase is necessary to be 5% or less, preferably 3% or less.

When the ferrite contains precipitates containing Ti and Mo, and that the mean diameter of the precipitates is 20 nm or less, preferably 10 nm or less, and the mean distance between the precipitates is 60 nm or less, preferably 40 nm or less, the hardness of the ferrite determined by a Nano Hardness Tester becomes 3 to 8 GPa, and the hardness of the second phase of bainite and/martensite becomes 6 to 13 GPa, which makes smaller the difference in hardness between the ferrite and the second phase, resulting in further excellent elongation and stretch-flangeability.

The composition of the precipitates existing in the ferrite was analyzed by energy-dispersive X-ray spectrometer equipped in TEM. With the assumption that the precipitates have a circular shape, the mean diameter thereof was determined by image processing. The mean distance between the precipitates was calculated by counting the number of the precipitates existing in a 300 nm square zone by TEM observation, and by measuring the film thickness of the specimen and calculating the volume of the zone where the precipitates were counted assuming the uniform dispersion of the precipitates.

When the steel sheet according to the present invention is manufactured by the method according to the present invention, the areal percentage of bainite becomes 60% or less, and the areal percentage of martensite becomes 35% or less.

The areal percentage of martensite was measured by the following steps. After polishing the cross section of the steel sheet, the section was etched by a 1:1 mixed solution of 4% alcoholic picric acid and 2% sodium pyrosulfate. The etched surface at a position of ¼ of sheet thickness was observed by optical microscope. Then the areal percentage of martensite observed in white was determined by image processing. The areal percentage of bainite was determined by scanning electron microscope (SEM) (1000 of magnification) and by image processing. The kind of the other phase other than the ferrite, the bainite, and the martensite was identified by SEM observation. The areal percentage of the other phase was assumed as the areal percentage of the other phase other than the ferrite containing precipitates, martensite, and bainite.

The hardness of the ferrite and the second phase was determined using a Nano Hardness Tester TRIBOSCOPE produced by Hysitron Co., Ltd. by adjusting the load to give the dent depths of 50±20 nm, by measuring 10 points at a position of ¼ of sheet thickness and averaging the values of these 10 points. The length of a side of the dent was about 350 nm. The Nano Hardness Tester allows the precise measurement of the hardness of the second phase of dual phase steel, which could not be determined precisely in a conventional manner.

3) Manufacturing Method 3.1 Slab Reheating Temperature (SRT)

The slab having the above-given chemical composition is manufactured by continuous casting process or (ingot making+slabbing) process. The slab has already contained precipitates (mainly Ti-based carbides) to be used for precipitation hardening of the ferrite after hot rolling, though they are coarse. Since the coarse precipitates have very little strengthening ability, they are required to be once dissolved during the slab reheating step before hot rolling, and to be finely reprecipitated after hot rolling. To do this, the slab has to be reheated to 1150° C. or above. On the other hand, reheating to above 1300° C. forms coarse microstructure to degrade the elongation and the stretch-flangeability. Therefore, the SRT is specified to a range from 1150 to 1300° C., preferably from 1200 to 1300° C.

3.2 Finishing Temperature

When the hot rolling is finished in a two-phase zone of ferrite+austenite, residual strain is left in the ferrite after hot rolling to degrade the elongation. Accordingly, the temperature just after the hot rolling is finished, or the finishing temperature, has to be kept at the Ar3 transformation temperature or above in the zone of austenite single phase.

The Ar3 transformation temperature is affected by the composition of steel sheet, and expressed, for example, by the formula (1);

$$\text{Ar3 temp.}=910-203\times[C]^{1/2}+44.7\times[Si]-30\times[Mn]+31.5\times[Mo] \quad (1)$$

where [M] designates the content of element M, % by mass.

3.3 Cooling After Hot Rolling

To have 40% or higher percentage of the ferrite containing precipitates, the hot rolled steel sheet has to be subjected to primary cooling to a temperature range from 700 to 850° C. at an average cooling rate of 20° C./s or more, preferably 50° C./s or more, then to holding at a temperature of 680° C. or above for more than 1 sec, preferably 3 sec or more. If the average cooling rate is less than 20° C./s or if the holding temperature is below 680° C., the driving force for ferrite transformation becomes insufficient. If the holding time is less than 1 sec, the ferrite transformation time is insufficient. Both of which fail to obtain 40% or higher percentage of the ferrite containing precipitates.

To hold the steel sheet at a temperature of 680° C. or above for more than 1 sec, air cooling may be applicable after primary cooling to a temperature range from 700 to 850° C. at an average cooling rate of 20° C./s or more.

Furthermore, to form precipitates containing Ti and Mo in the ferrite, and to make the mean diameter of the precipitates of 20 nm or less, and to make the mean distance between the precipitates of 60 nm or less, it is preferable that the steel sheet is primarily cooled to a temperature range not only from 700 to 850° C. but also from (SRT/3+300) to (SRT/8+700)° C. It seems to be due to the fact that the amount of Ti-based carbides dissolving in the slab depends on the SRT so that the SRT gives significant influence on the diameter of the precipitates and the distance between the precipitates, which are formed during the cooling stage after hot rolling.

After holding the steel sheet longer than 1 sec at a temperature of 680° C. or above, it is necessary to apply secondary cooling to 550 ° C. or below, preferably 450° C. or below, and more preferably 350° C. or below at an average cooling rate of 30° C./s or more, preferably 50° C./s or more, and coiling in order to form the secondary phase of bainite and/or martensite and to suppress the formation of other phase at 5% or smaller percentage.

EXAMPLES

The steels A through U having the chemical composition given in Table 1 were smelt in a converter and continuously cast to slabs. The slabs were hot rolled under the conditions given in Table 2-1 and Table 2-2, thus obtained steel sheets 1 through 34 having a thickness of 1.4 mm. The Ar3 temperature in Table 1 was determined by the above-given formula (1). Using the above-described method, the structure and the precipitates were analyzed, and the hardness was measured. Furthermore, JIS No.5 Specimens were cut from the steel sheets in the direction lateral to the rolling direction and subjected to the tensile test in accordance with JIS Z 2241 to determine the tensile strength (TS) and the elongation (El). To evaluate the stretch-flangeability, a hole expansion test was conducted in accordance with JFST 1001 (The Japan Iron and Steel Federation Standard 1001) to determine the hole expansion ratio (λ).

The target values according to the present invention are TS≧780 MPa, El≧22%, and λ≧60%.

The result is given in Table 3-1 and Table 3-2.

The steel sheets 1, 5, 9, 11 to 13, 18 to 19, 21 to 23, 25, 26, and 28 to 34 according to the present invention show TS≧780 MPa, El≧22%, and λ≧60%, that is, having high strength and excellent elongation and stretch-flangeability.

TABLE 1

| | Chemical composition (mass %) | | | | | | | | Ar3 temp. |
|---|---|---|---|---|---|---|---|---|---|
| Steel | C | Si | Mn | P | S | Al | Mo | Ti | (° C.) |
| A | 0.04 | 0.57 | 1.17 | 0.013 | 0.003 | 0.030 | 0.09 | 0.12 | 863 |
| B | 0.05 | 1.02 | 0.82 | 0.013 | 0.002 | 0.039 | 0.18 | 0.13 | 891 |
| C | 0.07 | 0.61 | 0.81 | 0.012 | 0.002 | 0.031 | 0.07 | 0.05 | 861 |
| D | 0.09 | 0.37 | 0.54 | 0.014 | 0.003 | 0.035 | 0.42 | 0.11 | 863 |
| E | 0.06 | 0.14 | 0.94 | 0.014 | 0.001 | 0.026 | 0.14 | 0.07 | 843 |
| F | 0.08 | 0.54 | 1.52 | 0.014 | 0.002 | 0.035 | 0.24 | 0.08 | 839 |
| G | 0.02 | 0.58 | 1.36 | 0.012 | 0.004 | 0.038 | 0.11 | 0.10 | 870 |
| H | 0.05 | 0.40 | 0.40 | 0.015 | 0.003 | 0.037 | 0.14 | 0.09 | 875 |
| I | 0.07 | 0.81 | 0.80 | 0.012 | 0.005 | 0.039 | 0.02 | 0.12 | 869 |
| J | 0.07 | 0.93 | 1.10 | 0.011 | 0.002 | 0.025 | 0.16 | 0.02 | 870 |
| K | 0.12 | 0.85 | 0.75 | 0.015 | 0.003 | 0.032 | 0.08 | 0.13 | 858 |
| L | 0.15 | 0.72 | 1.02 | 0.012 | 0.003 | 0.038 | 0.06 | 0.06 | 835 |
| M | 0.17 | 0.80 | 0.70 | 0.010 | 0.002 | 0.038 | 0.11 | 0.09 | 845 |
| N | 0.12 | 1.16 | 1.22 | 0.024 | 0.003 | 0.031 | 0.12 | 0.10 | 859 |
| O | 0.09 | 1.48 | 1.00 | 0.013 | 0.002 | 0.029 | 0.15 | 0.09 | 890 |
| P | 0.07 | 0.62 | 0.64 | 0.012 | 0.003 | 0.030 | 0.15 | 0.14 | 870 |
| Q | 0.06 | 1.10 | 0.97 | 0.032 | 0.004 | 0.030 | 0.20 | 0.07 | 887 |
| R | 0.08 | 1.06 | 0.92 | 0.019 | 0.003 | 0.032 | 0.17 | 0.09 | 878 |
| S | 0.06 | 0.65 | 1.13 | 0.014 | 0.002 | 0.032 | 0.16 | 0.11 | 860 |
| T | 0.07 | 0.81 | 0.62 | 0.033 | 0.003 | 0.035 | 0.06 | 0.04 | 876 |
| U | 0.10 | 1.02 | 0.75 | 0.027 | 0.002 | 0.035 | 0.30 | 0.06 | 878 |

Value with underline: Outside the range of the present invention

TABLE 2-1

| Steel sheet | Steel | SRT (° C.) | Finishing temp. (° C.) | Primary cooling rate (° C./s) | Primary cooling stop temp. (° C.) | SRT/8 + 700 (° C.) | SRT/3 + 300 (° C.) | Holding time (s) | Secondary cooling start temp. (° C.) | Secondary cooling rate (° C./s) | Coiling temp. (° C.) | Remark |
|---|---|---|---|---|---|---|---|---|---|---|---|---|
| 1 | A | 1200 | 880 | 50 | 750 | 850 | 700 | 5 | 720 | 50 | 40 | Example |
| 2 | A | 1200 | 880 | 30 | 750 | 850 | 700 | 5 | 720 | 20 | 40 | Comparative Example |

TABLE 2-1-continued

| Steel sheet | Steel | SRT (° C.) | Finishing temp. (° C.) | Primary cooling rate (° C./s) | Primary cooling stop temp. (° C.) | SRT/8 + 700 (° C.) | SRT/3 + 300 (° C.) | Holding time (s) | Secondary cooling start temp. (° C.) | Secondary cooling rate (° C./s) | Coiling temp. (° C.) | Remark |
|---|---|---|---|---|---|---|---|---|---|---|---|---|
| 3 | A | 1100 | 880 | 50 | 750 | 838 | 667 | 5 | 720 | 50 | 40 | Comparative Example |
| 4 | A | 1200 | 840 | 50 | 750 | 850 | 700 | 5 | 720 | 50 | 40 | Comparative Example |
| 5 | B | 1250 | 900 | 40 | 780 | 856 | 717 | 4 | 740 | 40 | 70 | Example |
| 6 | B | 1250 | 900 | 10 | 780 | 856 | 717 | 4 | 740 | 40 | 70 | Comparative Example |
| 7 | B | 1250 | 900 | 40 | 650 | 856 | 717 | 4 | 580 | 40 | 70 | Comparative Example |
| 8 | B | 1250 | 900 | 40 | 780 | 856 | 717 | 1 | 760 | 40 | 70 | Comparative Example |
| 9 | C | 1270 | 880 | 60 | 740 | 859 | 723 | 6 | 700 | 60 | 120 | Example |
| 10 | C | 1270 | 880 | 60 | 740 | 859 | 723 | 6 | 700 | 60 | 600 | Comparative Example |
| 11 | D | 1180 | 950 | 70 | 840 | 848 | 693 | 7 | 800 | 70 | 400 | Example |
| 12 | E | 1230 | 870 | 90 | 820 | 854 | 710 | 7 | 780 | 60 | 240 | Example |
| 13 | F | 1250 | 910 | 30 | 790 | 856 | 717 | 6 | 740 | 30 | 320 | Example |
| 14 | G | 1280 | 890 | 40 | 720 | 860 | 727 | 5 | 700 | 40 | 40 | Comparative Example |

Value with underline: Outside the range of the present invention

TABLE 2-2

| Steel sheet | Steel | SRT (° C.) | Finishing temp. (° C.) | Primary cooling rate (° C.) | Primary cooling stop temp. (° C.) | SRT/8 + 700 (° C.) | SRT/3 + 300 (° C.) | Holding time (s) | Secondary cooling start temp. (° C.) | Secondary cooling rate (° C./s) | Coiling temp. (° C.) | Remark |
|---|---|---|---|---|---|---|---|---|---|---|---|---|
| 15 | H | 1270 | 915 | 40 | 740 | 859 | 723 | 4 | 700 | 40 | 200 | Comparative Example |
| 16 | I | 1200 | 885 | 50 | 760 | 850 | 700 | 4 | 710 | 50 | 310 | Comparative Example |
| 17 | J | 1190 | 900 | 70 | 710 | 849 | 697 | 6 | 690 | 70 | 150 | Comparative Example |
| 18 | K | 1250 | 880 | 30 | 750 | 856 | 717 | 7 | 715 | 30 | 450 | Example |
| 19 | L | 1220 | 860 | 50 | 790 | 853 | 707 | 8 | 750 | 50 | 400 | Example |
| 20 | M | 1250 | 870 | 40 | 750 | 856 | 717 | 6 | 720 | 80 | 350 | Comparative Example |
| 21 | N | 1200 | 890 | 80 | 800 | 850 | 700 | 11 | 755 | 100 | 200 | Example |
| 22 | O | 1270 | 910 | 100 | 820 | 859 | 723 | 15 | 780 | 60 | 500 | Example |
| 23 | P | 1200 | 920 | 30 | 810 | 850 | 700 | 7 | 775 | 60 | 300 | Example |
| 24 | P | 1200 | 920 | 30 | 870 | 850 | 700 | 9 | 825 | 60 | 300 | Comparative Example |
| 25 | Q | 1230 | 900 | 90 | 780 | 854 | 710 | 5 | 755 | 70 | 420 | Example |
| 26 | R | 1210 | 930 | 60 | 800 | 851 | 703 | 6 | 770 | 60 | 370 | Example |
| 27 | R | 1210 | 930 | 60 | 860 | 851 | 703 | 6 | 830 | 60 | 370 | Comparative Example |
| 28 | S | 1155 | 880 | 50 | 850 | 844 | 685 | 5 | 830 | 80 | 350 | Example |
| 29 | S | 1220 | 880 | 50 | 750 | 853 | 707 | 5 | 740 | 80 | 350 | Example |
| 30 | S | 1250 | 880 | 50 | 700 | 856 | 717 | 5 | 690 | 80 | 350 | Example |
| 31 | T | 1220 | 900 | 40 | 830 | 853 | 707 | 10 | 780 | 50 | 100 | Example |
| 32 | T | 1200 | 920 | 40 | 780 | 850 | 700 | 3 | 810 | 50 | 300 | Example |
| 33 | T | 1180 | 920 | 40 | 780 | 848 | 693 | 3 | 815 | 50 | 550 | Example |
| 34 | U | 1230 | 890 | 60 | 750 | 854 | 710 | 7 | 730 | 60 | 520 | Example |

Value with underline: Outside the range of the present invention

TABLE 3-1

| Steel sheet | Steel | Microstructure: F (%) | Second phase: B (%) | Second phase: M (%) | Other phase (%) | Other phase | Mechanical properties: TS (MPa) | El (%) | λ (%) | Precipitates: Mean diameter (nm) | Mean distance between them (nm) | Hardness: Ferrite (GPa) | Second phase (GPa) | Remark |
|---|---|---|---|---|---|---|---|---|---|---|---|---|---|---|
| 1 | A | 70 | 0 | 30 | 0 | — | 822 | 24 | 71 | 10 | 40 | 6.3 | 8.1 | Example |
| 2 | A | 65 | 10 | 10 | 15 | P | 760 | 20 | 65 | 9 | 38 | 4.6 | 8.4 | Comparative Example |
| 3 | A | 50 | 0 | 20 | 30 | f | 715 | 25 | 58 | 13 | 50 | 2.8 | 8.1 | Comparative Example |
| 4 | A | 60 | 0 | 20 | 20 | f | 781 | 18 | 57 | 10 | 36 | 2.1 | 8.7 | Comparative Example |
| 5 | B | 80 | 0 | 20 | 0 | — | 813 | 24 | 65 | 11 | 42 | 5.2 | 8.7 | Example |
| 6 | B | 15 | 0 | 30 | 55 | f | 751 | 24 | 47 | 13 | 35 | 2.6 | 8.8 | Comparative Example |
| 7 | B | 10 | 0 | 20 | 70 | f | 654 | 24 | 34 | 8 | 22 | 2.2 | 8.5 | Comparative Example |
| 8 | B | 10 | 20 | 70 | 0 | — | 924 | 17 | 45 | 10 | 31 | 2.1 | 9.0 | Comparative Example |
| 9 | C | 60 | 10 | 30 | 0 | — | 843 | 23 | 73 | 9 | 33 | 7.1 | 8.1 | Example |
| 10 | C | 60 | 20 | 0 | 20 | P | 736 | 20 | 78 | 7 | 35 | 2.2 | 5.5 | Comparative Example |
| 11 | D | 55 | 45 | 0 | 0 | — | 823 | 22 | 84 | 14 | 19 | 6.1 | 7.2 | Example |
| 12 | E | 70 | 28 | 0 | 2 | f | 782 | 23 | 89 | 15 | 30 | 7.6 | 7.1 | Example |
| 13 | F | 60 | 40 | 0 | 0 | — | 801 | 22 | 87 | 13 | 29 | 4.9 | 7.3 | Example |
| 14 | G | 80 | 0 | 20 | 0 | — | 698 | 24 | 72 | 9 | 21 | 2.3 | 4.6 | Comparative Example |

Value with underline: Outside the range of the present invention
F: Ferrite containing precipitate,
f: Ferrite without precipitate,
B: Bainite,
M: Martensite,
P: Pearlite

TABLE 3-2

| Steel sheet | Steel | Microstructure: F (%) | Second phase: B (%) | Second phase: M (%) | Other phase (%) | Other phase | Mechanical properties: TS (MPa) | EI (%) | λ (%) | Precipitates: Mean diameter (nm) | Mean distance between them (nm) | Hardness: Ferrite (GPa) | Second phase (GPa) | Remark |
|---|---|---|---|---|---|---|---|---|---|---|---|---|---|---|
| 15 | H | 50 | 50 | 0 | 0 | — | 671 | 25 | 61 | 8 | 24 | 2.2 | 5.9 | Comparative Example |
| 16 | I | 60 | 40 | 0 | 0 | — | 731 | 20 | 63 | 14 | 31 | 2.1 | 5.8 | Comparative Example |
| 17 | J | 60 | 0 | 40 | 0 | — | 852 | 22 | 43 | 6 | 81 | 22.8 | 10.1 | Comparative Example |
| 18 | K | 75 | 10 | 11 | 4 | f | 980 | 22 | 63 | 7 | 27 | 5.1 | 8.6 | Example |
| 19 | L | 65 | 5 | 30 | 0 | — | 982 | 23 | 61 | 11 | 30 | 4.9 | 8.7 | Example |
| 20 | M | 37 | 5 | 58 | 0 | — | 1001 | 15 | 28 | 14 | 27 | 4.8 | 8.9 | Comparative Example |
| 21 | N | 70 | 5 | 25 | 0 | — | 831 | 23 | 61 | 12 | 36 | 7.1 | 12.1 | Example |
| 22 | O | 80 | 20 | 0 | 0 | — | 812 | 25 | 68 | 16 | 41 | 4.6 | 7.8 | Example |
| 23 | P | 68 | 17 | 15 | 0 | — | 822 | 23 | 67 | 13 | 30 | 5.4 | 9.0 | Example |
| 24 | P | 32 | 42 | 23 | 3 | f- | 862 | 23 | 42 | 23 | 71 | 2.6 | 10.2 | Comparative Example |
| 25 | Q | 60 | 35 | 5 | 0 | — | 800 | 22 | 64 | 10 | 38 | 4.7 | 8.1 | Example |
| 26 | R | 75 | 20 | 5 | 0 | — | 840 | 24 | 65 | 9 | 36 | 5.3 | 8.5 | Example |
| 27 | R | 30 | 32 | 17 | 21 | f | 815 | 24 | 37 | 25 | 66 | 2.2 | 9.1 | Comparative Example |
| 28 | S | 62 | 24 | 14 | 0 | — | 815 | 22 | 60 | 26 | 68 | 2.4 | 8.1 | Example |
| 29 | S | 72 | 17 | 11 | 0 | — | 861 | 24 | 79 | 9 | 28 | 6.9 | 8.7 | Example |
| 30 | S | 64 | 6 | 30 | 0 | — | 883 | 22 | 60 | 9 | 69 | 2.4 | 8.6 | Example |
| 31 | T | 82 | 5 | 13 | 0 | — | 792 | 22 | 62 | 16 | 51 | 3.5 | 13.0 | Example |
| 32 | T | 45 | 20 | 35 | 0 | — | 964 | 24 | 60 | 9 | 30 | 5.8 | 12.1 | Example |

TABLE 3-2-continued

| | | Microstructure | | | | | | | | Precipitates | | Hardness | | |
|---|---|---|---|---|---|---|---|---|---|---|---|---|---|---|
| | | | Second phase | | Other | | Mechanical properties | | | Mean | Mean distance | | Second | |
| Steel sheet | Steel | F (%) | B (%) | M (%) | phase (%) | Other phase | TS (MPa) | EI (%) | λ (%) | diameter (nm) | between them (nm) | Ferrite (GPa) | phase (GPa) | Remark |
| 33 | T | 40 | 60 | 0 | 0 | — | 826 | 22 | 64 | 10 | 36 | 5.1 | 8.5 | Example |
| 34 | U | 61 | 34 | 5 | 0 | — | 801 | 23 | 67 | 9 | 32 | 5.7 | 8.9 | Example |

Value with underline: Outside the range of the present invention
F: Ferrite containing precipitate,
f: Ferrite without precipitate,
B: Bainite,
M: Martensite,
P: Pearlite

The invention claimed is:

1. A high strength hot rolled steel sheet consisting of 0.04 to 0.15% C, 1.5% or less Si, 0.5 to 1.6% Mn, 0.04% or less P, 0.005% or less S, 0.04% or less Al, 0.03 to 0.15% Ti, 0.03 to 0.5% Mo, by mass, and balance of Fe and inevitable impurities, and having a microstructure consisting of ferrite containing precipitates, second phase of bainite and/or martensite, and other phase, wherein some of the precipitates in the ferrite containing precipitates contain Ti—Mo compound carbides, and the mean diameter of the precipitates is 20 nm or less and the mean distance between the precipitates is 60 nm or less, the hardness of the ferrite determined by a Nano Hardness Tester is 3 to 8 Gpa, the percentage of the ferrite containing precipitates is 40 to 95%, and the percentage of the other phase is 5% or less, and the steel sheet has a tensile strength of 780 Mpa or more.

2. The high strength hot rolled steel sheet of claim 1, wherein, before hot rolling a steel slab to form the steel sheet, the steel slab is reheated in a temperature range from 1200 to 1300° C.

3. A method for manufacturing a high strength hot rolled steel sheet comprising the steps of:

reheating a steel slab consisting of 0.04 to 0.15% C., 1.5% or less Si, 0.5 to 1.6% Mn, 0.04% or less P, 0.005% or less S, 0.04% or less Al, 0.03 to 0.15% Ti, 0.03 to 0.5% Mo, by mass, and balance of Fe and inevitable impurities, and having a microstructure consisting of ferrite containing precipitates, second phase of bainite and/or martensite, and other phase, some of the precipitates in the ferrite containing precipitates contain Ti—Mo compound carbides, and the mean diameter of the precipitates is 20 nm or less and the mean distance between the precipitates is 60 nm or less, and the percentage of the ferrite containing precipitates is 40 to 95%, and the percentage of the other phase is 5% or less, in a temperature range from 1200 to 1300° C.;

hot rolling the reheated steel slab at a finishing temperature of the $Ar_3$ transformation temperature or above into a hot rolled steel sheet;

primarily cooling the hot rolled steel sheet in a temperature range from 700 to 850° C. at an average cooling rate of 20° C./s or more; holding the primarily cooled steel sheet at a temperature of 680° C. or above for more than 1 sec; and secondarily cooling the steel sheet at a temperature of 550° C. or below at an average cooling rate of 30 ° C./s or more, followed by coiling the steel sheet, wherein the hardness of the ferrite determined by a Nano Hardness Tester is 3 to 8 Gpa, and the steel sheet has a tensile strength of 780 Mpa or more.

4. The method for manufacturing a high strength hot rolled steel sheet of claim 3, wherein the hot rolled steel sheet is primarily cooled to a temperature range not only from 700 to 850° C. but also from (SRT/3 +300) to (SRT/8+700) ° C., where the SRT designates the reheating temperature of the steel slab.

* * * * *